US009240161B2

(12) United States Patent
Cho

(10) Patent No.: US 9,240,161 B2
(45) Date of Patent: Jan. 19, 2016

(54) SYSTEM AND DISPLAY FOR CONTROLLING DISPLAY

(71) Applicant: Samsung Electronics Co. Ltd., Suwon-si, Gyeonggi-do (KR)

(72) Inventor: Youngho Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 251 days.

(21) Appl. No.: 13/945,461

(22) Filed: Jul. 18, 2013

(65) Prior Publication Data

US 2014/0021868 A1 Jan. 23, 2014

(30) Foreign Application Priority Data

Jul. 19, 2012 (KR) ..... 10-2012-0078679

(51) Int. Cl.

| | |
|---|---|
| ***H05B 37/02*** | (2006.01) |
| ***H05B 39/04*** | (2006.01) |
| ***H05B 41/36*** | (2006.01) |
| ***G09G 5/10*** | (2006.01) |
| ***G09G 3/34*** | (2006.01) |

(52) U.S. Cl.

CPC ..... *G09G 5/10* (2013.01); *G09G 3/3406* (2013.01); *G09G 2320/0626* (2013.01); *G09G 2360/144* (2013.01)

(58) Field of Classification Search

CPC ..... H05B 39/042; H05B 41/3922; H05B 39/081; H05B 37/0218; Y02B 20/14

USPC ..... 315/158; 345/207

See application file for complete search history.

(56) References Cited

U.S. PATENT DOCUMENTS

| | | | | |
|---|---|---|---|---|
| 2012/0169236 | A1* | 7/2012 | Kim | 315/127 |
| 2012/0242633 | A1* | 9/2012 | Kim et al. | 345/207 |
| 2013/0021308 | A1* | 1/2013 | Ge | 345/207 |
| 2013/0207949 | A1* | 8/2013 | Jiang et al. | 345/207 |

* cited by examiner

*Primary Examiner* — Quan Tra

(74) *Attorney, Agent, or Firm* — Jefferson IP Law, LLP

(57) ABSTRACT

A system and method that adjusts a screen brightness of a display, considering an ambient illumination state, are provided. The method includes receiving a signal, corresponding to an event related to an illumination state alteration, from a sensor, confirming the event, and adjusting, if the event is confirmed, a screen brightness of a display unit in accordance with the event.

9 Claims, 6 Drawing Sheets

SYSTEM AND DISPLAY FOR CONTROLLING DISPLAY

PRIORITY

This application claims the benefit under 35 U.S.C. §119(a) of a Korean patent application filed on Jul. 19, 2012 in the Korean Intellectual Property Office and assigned Serial No. 10-2012-0078679, the entire disclosure of which is hereby incorporated by reference.

BACKGROUND OF THE INVENTION

1. Field of the Invention

The present invention relates to display systems. More particularly, the present invention relates to a system and method for adjusting screen brightness of a display, considering an ambient illumination state of the display.

2. Description of the Related Art

Displays refer to devices that are installed in a variety of electronic devices and show corresponding information. Displays are typically implemented with flat display panels, such as a Liquid Crystal Display (LCD), Organic Light Emitting Diodes (OLEDs), Active Matrix Organic Light Emitting Diodes (AMOLEDs), etc.

Since displays are components in electronic devices that primarily consume electric power, they are equipped with a function for adjusting screen brightness. For example, the screen brightness adjusting function may be implemented with a key for adjusting screen brightness. It may also be implemented with a system that detects the ambient illumination state of the display and automatically adjusts the screen brightness accordingly. To this end, displays are equipped with illuminance sensors. Illuminance sensors detect at least one light component, such as infrared, and the detected light is used to adjust screen brightness. The detected infrared signal is used to increase the screen brightness of a display to the brightest level only if the luminous intensity is high.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide a system and method for automatically adjusting screen brightness of a display, thereby enhancing the reliability of screen brightness control.

Another aspect of the present invention is further to provide a system and method for incorporating an illumination state near a display to the screen brightness state before executing the screen brightness adjusting command, thereby efficiently adjusting the screen brightness.

In accordance with an aspect of the present invention, a display control method is provided. The method includes receiving a signal, corresponding to an event related to an illumination state alteration, from a sensor, confirming the event, and adjusting, if the event is confirmed, a screen brightness of a display unit in accordance with the event.

Preferably, the confirming of the event includes transferring a first request message requesting measurement data of an ambient illuminance in response to the event signal to the sensor, receiving a first reply message including the measurement data from the sensor, determining whether the measurement data included in the first reply message is within a range of an illuminance level, and adjusting, if the measurement data included in the first reply message is within the range of the illuminance level, the screen brightness of a display unit in accordance with the event signal.

Preferably, the event signal includes information regarding a measured illuminance level.

Preferably, the adjustment of the screen brightness includes transferring a command signal including a level of screen brightness to be adjusted based on the range of the illuminance level included in the event signal.

Preferably, the adjustment of the screen brightness includes transferring a command signal for adjusting the screen brightness to the display unit, transferring a second request message for requesting measurement data of the ambient illuminance to the sensor, receiving a second reply message including the measurement data from the sensor, and transferring, if the measurement data included in the second reply message is not within the range of the illuminance level corresponding to the command signal, a command signal to stop the screen brightness adjustment to the display unit.

Preferably, the transfer of the second request message includes repeatedly transferring the second request message until either the second reply message is not within the range of the illuminance level corresponding to the command signal or the second request message has been transferred to the sensor a preset number of times.

In accordance with another aspect of the present invention, a display control method is provided. The method includes receiving a signal corresponding to an event related to an illumination state alteration from a sensor, transferring a command signal for adjusting a screen brightness of a display unit in response to the event signal, and transferring a command signal to stop the screen brightness adjustment to the display unit when the event is determined to be concluded.

Preferably, the determining of the conclusion of the event includes transferring a request message requesting measurement data of an ambient illuminance to the sensor, receiving a reply message including the measurement data from the sensor, and determining whether the measurement data is within a range of an illuminance level corresponding to the command signal.

In accordance with another aspect of the present invention, a display control system is provided. The system includes a sensor for measuring illuminance levels and detecting an alteration in an illuminance, a display unit including a module for adjusting a screen brightness, wherein the display unit displays graphics, and a controller for receiving a signal corresponding to an event related to an illumination state alteration from the sensor, confirming the event, and controlling to adjust, when the event is confirmed, the screen brightness in accordance with the event.

Preferably, the confirming of the event comprises, at the controller, transferring a first request requesting measurement data of the illuminance in response to the event signal to the sensor, receiving first measurement data from the sensor, and determining whether the measurement data is within a range of an illuminance level corresponding to the event signal Preferably, the controlling to adjust comprises, at the controller, transferring a command signal for adjusting the screen brightness of the display unit in response to the event signal.

Preferably, the controller transfers a second request requesting measurement data of the illuminance to the sensor, receives second measurement data from the sensor, and transfers, if the second measurement data is not within the range of the illuminance level corresponding to the command signal, the command signal to stop the screen brightness adjustment to the display unit.

In accordance with another aspect of the present invention, a display control system is provided. The system includes a sensor for measuring illuminance levels and detecting an alteration in the illuminance, a display unit including a module for adjusting a screen brightness, wherein the display unit displays graphics, and a controller for receiving a signal corresponding to an event related to an illumination state alteration from the sensor, transferring a command signal for adjusting the screen brightness of the display unit in response to the event signal, and transferring a command signal to stop the screen brightness adjustment to the display unit when the event is determined to be concluded.

Preferably, the determining of the conclusion of the event includes requesting measurement data of an ambient illuminance from the sensor, receiving the measurement data from the sensor, and transferring, if the measurement data is not within a range of an illuminance level corresponding to the command signal, a command signal to stop the screen brightness adjustment.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
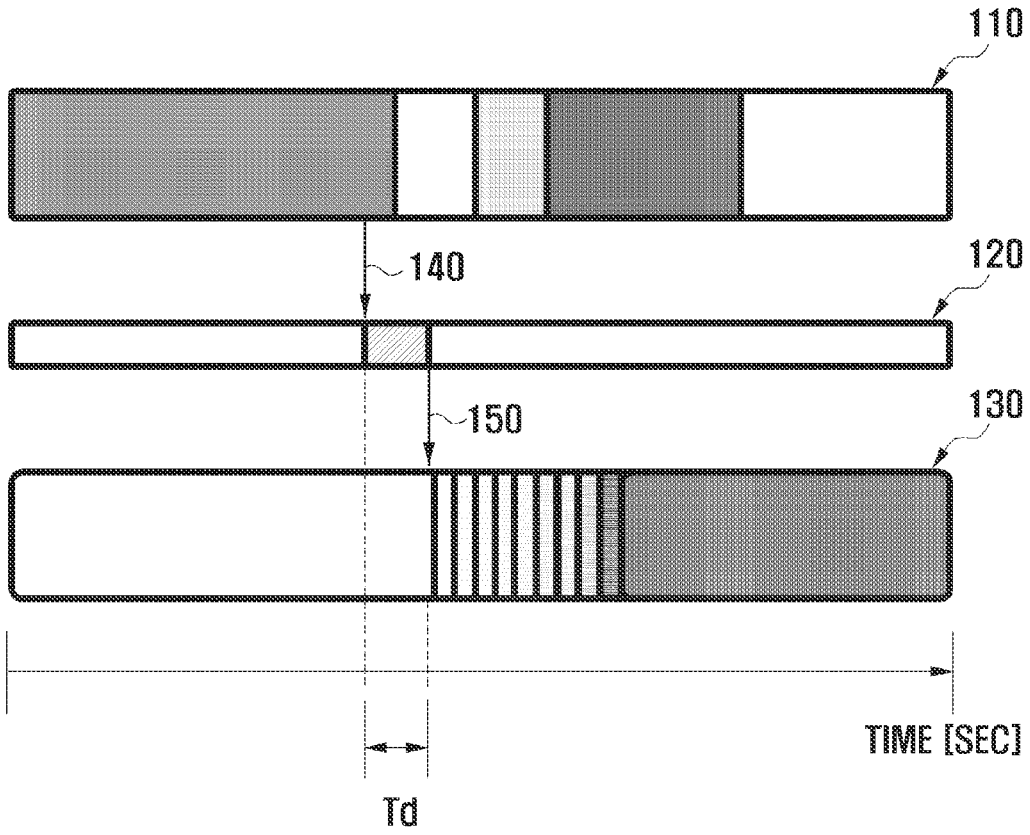
FIG. 1 (RELATED ART)
FIG. 1 illustrates a view describing a method for automatically controlling screen brightness of a display according to the related art.

FIG. 1 illustrates a view describing a method for automatically controlling a screen brightness of a display according to the related art.

FIG. 1 shows operation state bars of an illuminance sensor unit 110, a controller 120, and a display unit 130, included in a related-art display control device.

Referring to FIG. 1, the illuminance sensor unit 110 measures the illuminance of the ambient environment during a preset period, and ascertains that the ambient illumination is varied. If the illuminance sensor unit 110 ascertains that the ambient illumination is maintained for a period of time that is deemed reliable, it transfers a signal, corresponding to an event 140 that occurred when the illumination state was varied, to the controller 120. If the controller 120 detects that the event 140 has occurred, it transfers a screen brightness adjusting command signal 150 to the display unit 130. A brightness adjustment unit included in the display unit 130 adjusts the level of screen brightness in response to the screen brightness adjusting command signal. The related-art display control system is operated in such a way that the controller 120 receives a signal, corresponding to the event 140 that occurred when the illumination state was varied, and transfers the screen brightness adjusting command signal 150 to the display unit 130 to control the level of brightness according to the event. However, according to the signal process rate in the related-art system, the controller 120 causes a time difference $T_d$ between when it receives the state alteration event signal 140 and when it transfers the brightness adjusting command signal 150.

Although there is a difference between the illuminance levels when the state alteration event signal 140 is received and when the brightness adjusting command signal 150 is transferred, the related-art display control system adjusts the screen brightness of a display based on the time point that the state alteration event signal 140 is received. For example, the level of the ambient illumination of the display unit 130 may be reduced to a relatively small value at a time point when the state alteration event 140 occurs and then returned to a relatively large value around a time point when the brightness adjusting command signal 150 is created. In that case, although the display unit 130 is operating in a bright environment, the related-art display control system controls the display unit 130 to adjust the level of brightness according to the received, state alteration event 140.

The present disclosure provides a system and method for automatically controlling the screen brightness via an illuminance sensor, with a high level of reliability. If the display control system and method receives an event signal created when an illumination state is varied, it requests data acquired by measuring current illuminance and compares the currently measured data with the illumination state at a time point when the event occurred. If the event for the variation of an illumination state is deemed reliable, the display control system and method control the screen brightness. On the contrary, if the event for the variation of an illumination state is not deemed reliable, the display control system and method do not respond to the event.

The display control system and method can be can be applied to display devices with illuminance sensors, e.g., mobile phones, smart phones, tablet Personal Computers (PCs), hand-held PCs, Portable Multimedia Players (PMPs), Personal Digital Assistants (PDAs), TeleVision (TV), etc.

Figure 2:
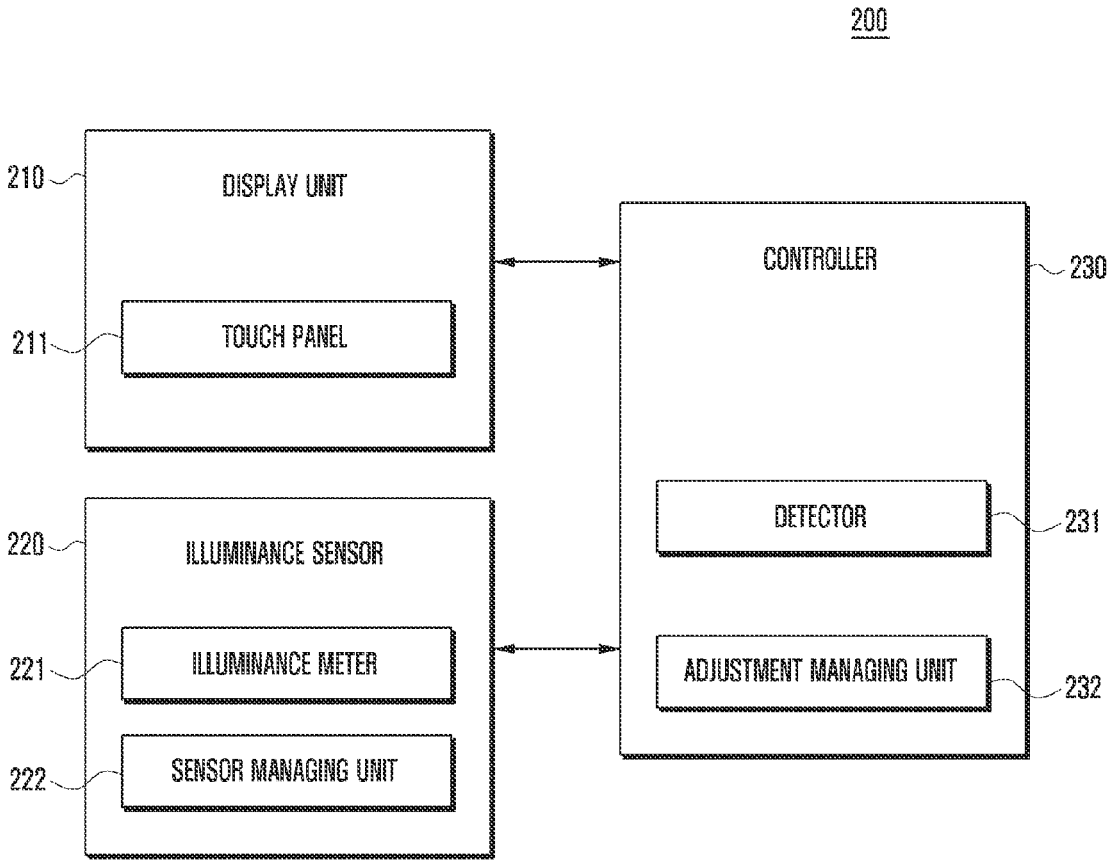
FIG. 2 illustrates a schematic block diagram showing a display control system according to an exemplary embodiment of the invention.

FIG. 2 illustrates a schematic block diagram showing a display control system according to an exemplary embodiment of the invention.

Referring to FIG. 2, the display control system 200 includes a display unit 210, an illuminance sensor 220 and a controller 230.

The display unit 210 displays menus of the display control system 200, and information input by the user or information provided to the user. The display unit 210 provides various types of screens according to the operations of the display control system 200. If the display control system 200 is implemented, for example, with a mobile device, it can display an idle screen, menu screens, a message writing screen, a call screen, a gaming screen, a music playback screen, etc. on the display unit 210. The display unit 210 may be implemented with flat display panels, such as a Liquid Crystal Display (LCD), Organic Light Emitting Diodes (OLEDs), Active Matrix Organic Light Emitting Diodes (AMOLEDs), etc.

If the display unit 210 is implemented with a touch-screen based LCD or OLED, it can also serve as an input device. To this end, the display unit 210 may further include a touch panel 211 for detecting touch actions. The touch panel 211 converts a touch applied to a location or the variation in capacitance at the location into an electrical signal. The touch panel 211 may be implemented with various types of sensors, such as a resistive type, a capacitive type, an electromagnetic induction type, a pressure type, etc. The touch panel 211 may detect a location, an area, a pressure, etc., for a touch action. The touch panel 211 detects a touch action, creates the corresponding signal, and transfers the signal to the controller 230. The controller 230 identifies a user's touch action via the received signal and executes a corresponding function.

Although it is not shown, the display unit 210 may further include a module for adjusting a screen brightness via a backlight. The brightness adjusting module adjusts the screen brightness of the display unit according to the screen brightness adjusting command signal from the controller 230. The display unit 210 may be adjusted in terms of 256 brightness levels from 0 to 255, for example. The number of brightness levels varies, depending on the type of display.

The illuminance sensor 220 measures the ambient illuminance near the display control system 200 and transfers the information regarding the ambient illumination state to the controller 230. The illuminance sensor 220 includes an illuminance meter 221 and a sensor managing unit 222. The illuminance meter 221 measures the ambient illuminance and transfers the measured illuminance to the sensor managing unit 222. The illuminance is a measure of how much luminous flux is spread over a given area, and expressed via the SI unit, lux. For example, one lux is equal to one lumen per square meter. The present invention is not limited thereto, and any unit of measurement of luminous flux may be used.

The illuminance meter 221 can measure a wide range of illuminance, for example, from 1 lux to hundreds of thousands of lux. However, it should be understood that the invention is not limited by the range. The illuminance meter 221 may periodically measure the ambient illuminance, for example, during a period of time in a range of 0.2~0.5 second.

The sensor managing unit 222 creates a state alteration event for reporting that the ambient illumination state is altered, via an algorithm. For example, the sensor managing unit 222 detects the alteration of the ambient illumination state via the data corresponding to the measured illuminance. In that case, the sensor managing unit 222 determines whether the altered illumination state is maintained for a period of time that is deemed reliable, e.g., a threshold period of time. If the sensor managing unit 222 ascertains that the altered illumination state has been maintained for the threshold period of time, the sensor managing unit 222 creates an event for reporting that the illumination state has been altered and transfers the state alteration event to the controller 230. The state alteration event may include information regarding the level of measured illuminance.

The state alteration event creating algorithm is executed in such a way as to divide the measured illuminance values by a plurality of levels, determine whether a level of measured illuminance is altered, and determine, if the level of measured illuminance has been altered, whether the altered illuminance state is maintained for the threshold period of time. In an exemplary embodiment of the present invention, it is assumed that the state alteration event creating algorithm is set in such a way that the range of illuminance that the illuminance meter 221 can measure is defined as 10 levels from levels 1 to 10. It should be understood that the range of illuminance to measure may be set to a number of levels other than 10 levels.

In addition, the range of illuminance to measure, included in level 1 to level 10, may overlap. For example, it is assumed that a first illuminance measured by the illuminance meter 221 is included in level 2 and a second illuminance is included in level 4. In that case, the sensor managing unit 222 ascertains that the measured illuminance of the ambient illumination is altered from level 2 to level 4. After that, the sensor managing unit 222 determines whether the measured illuminance is maintained at level 4 for a threshold period of time (e.g., 2 seconds). If the sensor managing unit 222 ascertains that the measured illuminance is maintained at level 4 for the threshold period of time, the sensor managing unit 222 creates a state alteration event for reporting that the ambient illumination state has been altered to level 4. On the contrary, if the sensor managing unit 222 ascertains that the measured illuminance is not maintained at level 4 for the threshold period of time, the sensor managing unit 222 does not create the state alteration event.

The controller 230 controls the entire operation of the display control system 200 and the signals between the components in the system 200. The controller 230 also performs data processing. The controller 230 controls the supply of electric power to the components in the display control system 200.

The controller 230 includes a detector 231 and an adjustment managing unit 232. The detector 231 receives a state alteration event signal from the illuminance sensor 220 and transfers the information regarding the level of illuminance included in the received signal to the adjustment managing unit 232.

When the state alteration event occurs, the adjustment managing unit 232 transfers a message requesting the measured, current illuminance, i.e., raw data, to the illuminance sensor 220. In that case, the illuminance sensor 220 measures the ambient illuminance at a time point that the illuminance sensor 220 received the request message, and transfers a reply message including the measured illuminance to the adjustment managing unit 232. The adjustment managing unit 232 compares the measured illuminance included in the reply message with the level of illuminance included in the state alteration event signal, and the determines whether to adjust the screen brightness of the display unit 210.

If the adjustment managing unit 232 ascertains that the measured illuminance included in the reply message is within the level of illuminance included in the state alteration event signal, the adjustment managing unit 232 creates a command signal for adjusting the screen brightness and transfers the command signal to the display unit 210. For example, the adjustment managing unit 232 creates a command signal for adjusting the screen brightness to meet the level of the ambient illuminance included in the state alteration event signal. On the contrary, if the adjustment managing unit 232 ascertains that the measured illuminance included in the reply message is not within the level of illuminance included in the state alteration event signal, the adjustment managing unit 232 does not create the command signal for adjusting the screen brightness.

After transferring the command signal for adjusting the screen brightness to the display unit 210, the adjustment managing unit 232 requests and receives measurement data of the ambient illuminance from the illuminance sensor 220. Alternatively, if the adjustment managing unit 232 transfers the command signal for adjusting the screen brightness to the display unit 210 and ascertains that the received measured illuminance is out of the range of illuminance corresponding to the transferred command signal, the adjustment managing unit 232 creates a command signal to stop the adjustment of screen brightness and transfers the command signal to the display unit 210.

In another exemplary embodiment of the invention, the controller 230 may further execute a variety of functions other than the operations described above. If the controller 230 receives an event signal related to the illuminance state alteration from the illuminance sensor 220, the controller 230 may transfer a command signal for adjusting the screen brightness of the display unit 210, in response to the event. After transferring the command signal, the controller 230 transfers a message requesting measurement data of the ambient illuminance to the illuminance sensor 220 and then receives the reply message with the measurement data. If the controller 230 ascertains that the received measured illuminance is out of the range of illuminance level corresponding to the transferred command signal, the controller 230 creates a command signal to stop the adjustment of screen brightness and transfers the command signal to the display unit 210.

The detailed operation of the controller is described as follows referring to the accompanying drawings.

Figure 3:
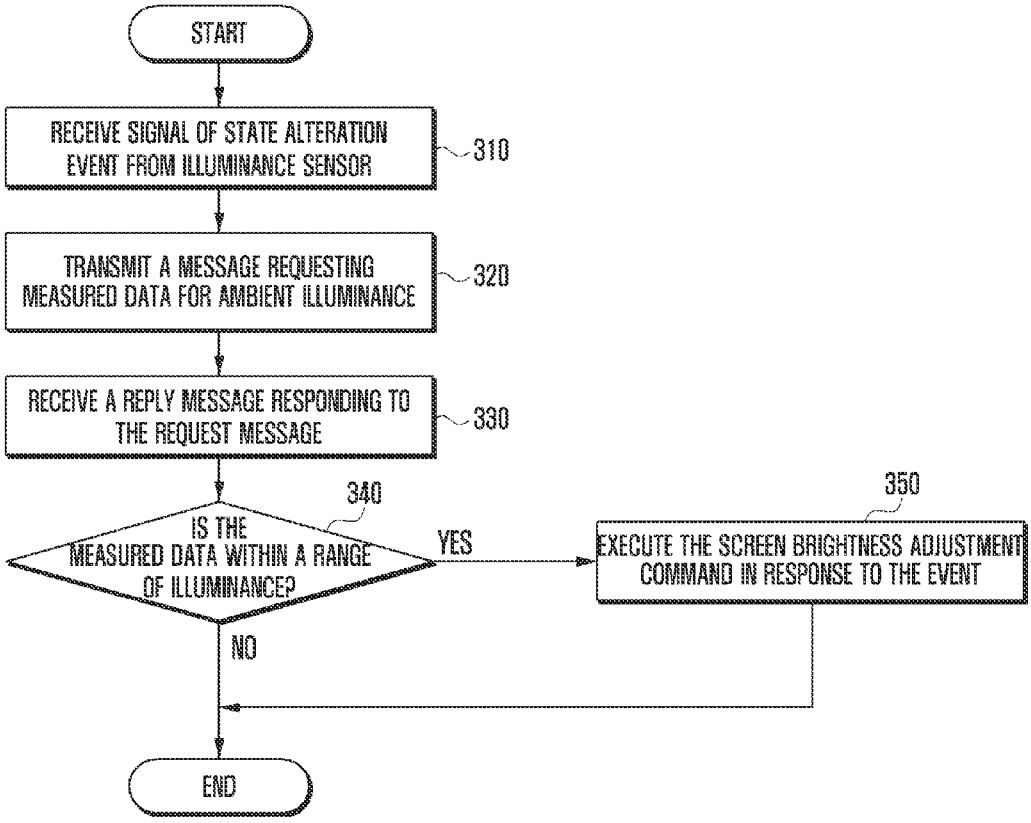
FIG. 3 illustrates a flowchart describing a first exemplary embodiment of a display control method according to an exemplary embodiment of the invention.

FIG. 3 illustrates a flowchart describing a first exemplary embodiment of a display control method according to an exemplary embodiment of the present invention.

Referring to FIG. 3, the controller 230 receives a state alteration event signal from the illuminance sensor 220 in step 310. The state alteration event signal includes a level of ambient illuminance measured by the illuminance sensor 220. For example, if the illuminance sensor 220 detects an ambient illuminance level increasing from level 2 to level 4 and ascertains that the ambient illuminance level is maintained at level 4 for a preset period of time, the illuminance sensor 220 transfers a state alteration event signal for reporting that the ambient illuminance level has been altered to level 4 to the controller 230. Therefore, the controller 230 ascertains that the ambient illuminance level has been altered to level 4, based on the received state alteration event signal.

The controller 230 transfers, to the illuminance sensor 220, a message allowing the illuminance sensor 220 to measure the ambient illuminance and requesting the measured level of ambient illuminance in step 320. The request message may be a message requesting a level of illuminance, i.e., raw data, measured by the illuminance sensor 220. The illuminance sensor 220 measures the ambient illuminance under the control of the controller 230, at a time when the illuminance sensor 220 received the request message. The illuminance sensor 220 transfers the reply message including the measured level of illuminance to the controller 230.

The controller 230 receives the reply message from the illuminance sensor 220 in step 330. The reply message may include raw data, i.e., a level of illuminance, measured by the illuminance sensor 220.

The controller 230 determines whether the measured level of illuminance is within a range of level corresponding to the state alteration event signal in step 340. If the controller 230 ascertains that the measured level of illuminance is within the range of level corresponding to the state alteration event signal at step 340, the controller 230 concludes that the state alteration event is reliable and creates a command signal for adjusting screen brightness of the display unit 210 in step 350.

On the contrary, if the controller 230 ascertains that the measured level of illuminance is not within the range of level corresponding to the state alteration event signal at step 340, the controller 230 concludes that the state alteration event is not reliable and terminates the procedure. For example, the controller 230 does not create the command signal for adjusting screen brightness of the display unit 210.

Figure 4A:
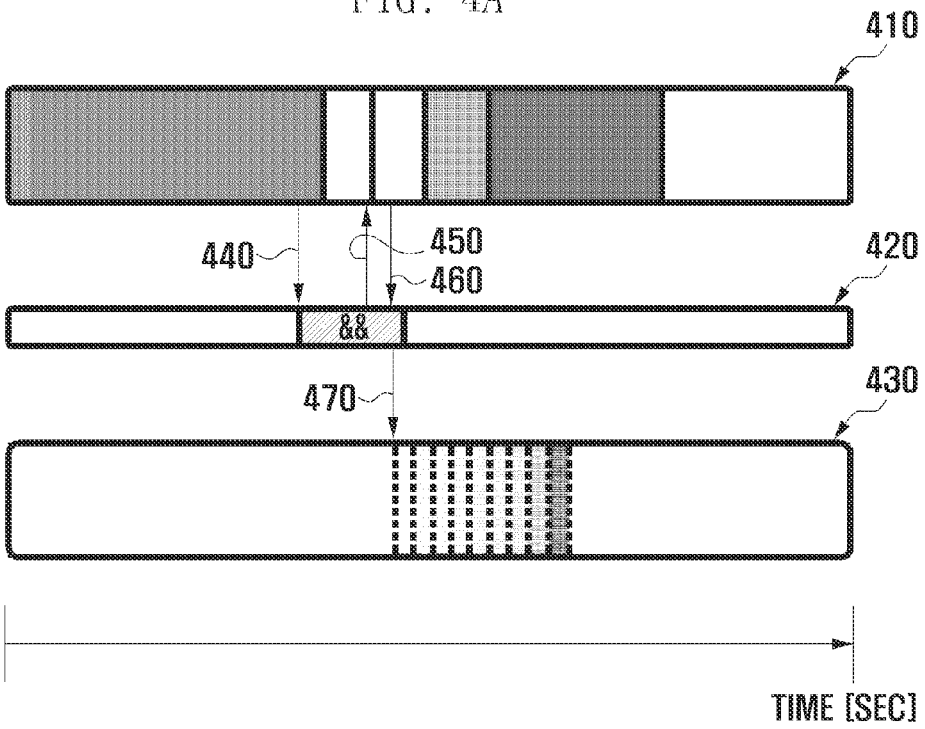
FIGS. 4A and 4B illustrate operation state bars describing the first embodiment of a display control method display according to an exemplary embodiment of the invention.
Figure 4B:
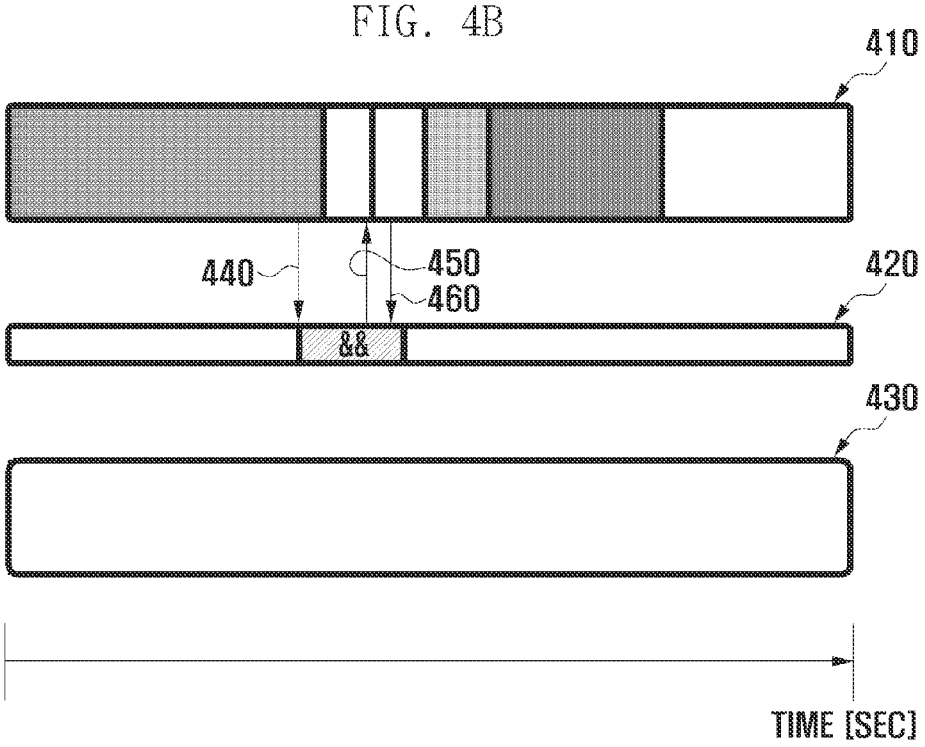

FIGS. 4A and 4B illustrate operation state bars describing a first exemplary embodiment of a display control method according to an exemplary embodiment of the present invention. FIG. 4A shows an operation where the controller 230 transfers a command signal for adjusting a screen brightness to the display unit 210 in response to a state alteration event. FIG. 4B shows an operation where the controller 230 does not transfer the command signal for adjusting the screen brightness to the display unit 210. As shown in FIGS. 4A and 4B, the reference numbers 410, 420 and 430 refer to the operation state bars of the illuminance sensor 220, the controller 230, and the display unit 210, respectively.

Referring to FIG. 3 and FIGS. 4A and 4B, the illuminance sensor 220, shown as operation state bar 410, continues detecting a low level of illuminance over a certain period of time. During the operation, if a state alteration event 440 occurs via a state alteration event creating algorithm, the illuminance sensor 220 creates the state alteration event signal and transfers it to the controller 230.

The controller 230, shown as operation state bar 420, first transfers, to the illuminance sensor 220, a message 450 allowing the illuminance sensor 220 to measure illuminance and requesting the measured illuminance therefrom. The illuminance sensor 220 measures the ambient illuminance in response to the request message 450. The sensor managing unit 222 of the illuminance sensor 220 creates a reply message 460 including the measured level of illuminance and transfers the reply message 460 to the controller.

The controller 230 receives the reply message 460 and determines whether the measured level of illuminance included in the reply message 460 is within a range of illuminance level included in the state alteration event 440. If the controller 230 ascertains that the measured level of illuminance included in the reply message 460 is within the range of illuminance level included in the state alteration event 440, the controller 230 creates a command signal 470 for adjusting a screen brightness of the display unit 210 shown as operation state bar 430, as shown in FIG. 4A. The command signal 470 is created in response to the state alteration event 440 to report that the ambient illumination state has been altered. The display unit 210 adjusts the screen brightness according to the command signal 470. For example, if the controller 230 ascertains that the ambient illuminance level has been altered to level 4 based on the state alteration event 440, the controller 230 transfers the command signal 470 for adjusting the screen brightness to level 4 to the display unit 210. The display unit 210 then adjusts the screen brightness to level 4 according to the command signal 470.

The controller 230 can control the display unit 210 to gradually adjust the screen brightness. For example, it is assumed that the number of levels to adjust the screen brightness for the display unit 210 is set from 0 to 255 and the screen brightness is currently level 100. If the display unit 210 receives the command signal 470 for adjusting the screen brightness to level 50, the display unit 210 may gradually decrease the screen brightness from level 100 to level 50.

Meanwhile, if the controller 230 ascertains that the measured level of illuminance included in the reply message 460 is not within the range of illuminance level included in the state alteration event 440, the controller 230 does not respond to the event 440, as shown in FIG. 4B. For example, the controller 230 does not create the command signal 470 for adjusting the screen brightness of the display unit 210, as shown in FIG. 4B. In the exemplary embodiment of the present invention, although the controller 230 receives an event signal reporting that the ambient illumination state has been altered, the controller 230 then maintains the current level of screen brightness, without performing the screen brightness adjustment.

Figure 5:
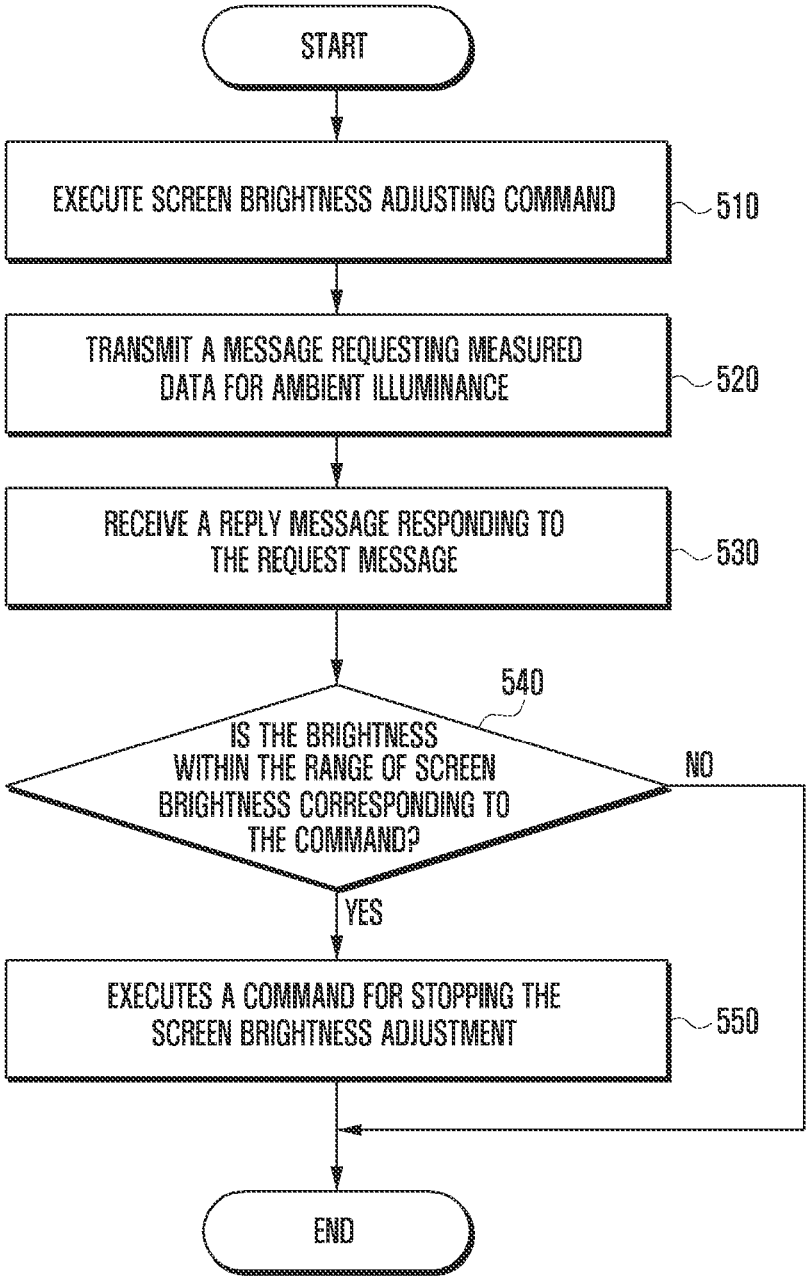
FIG. 5 illustrates a flowchart describing a second exemplary embodiment of a display control method according to an exemplary embodiment of the invention.

FIG. 5 illustrates a flowchart describing a second exemplary embodiment of a display control method according to an exemplary embodiment of the present invention.

Referring to FIG. 5, the controller 230 receives an event signal reporting that the ambient illumination state has been altered from the illuminance sensor 220 and transfers a command signal for adjusting screen brightness to the display unit 210 in step 510. For example, the controller 230 may create the command signal for adjusting the screen brightness via steps 310 to 350 described in FIG. 3. The controller 230 may transfer a command signal for adjusting the screen brightness immediately responding to the state alteration event signal. When the display unit 210 receives the command signal, the display unit 210 may gradually adjust the screen brightness.

After adjusting the screen brightness of the display unit 210, i.e., transferring the screen bright adjusting command signal to the display unit 210, the controller 230 transfers, to the illuminance sensor 220, a message requesting the illuminance sensor 220 to measure the ambient illuminance and requesting the measured level of ambient illuminance in step 520. The request message may be a message requesting a level of illuminance, i.e., raw data, measured by the illuminance sensor 220. The illuminance sensor 220 measures the ambient illuminance under the control of the controller 230, at a time when the illuminance sensor 220 received the request message. The illuminance sensor 220 transfers a reply message including the measured level of illuminance to the controller 230.

The controller 230 receives the reply message from the illuminance sensor 220 in step 530. The reply message may include raw data, i.e., a level of illuminance, measured by the illuminance sensor 220.

The controller 230 determines whether the measured level of illuminance is within a range of level corresponding to the screen brightness adjusting command signal in step 540. If the controller 230 ascertains that the measured level of illuminance is not within the range of level corresponding to the screen brightness adjusting command signal at step 540, the controller 230 creates a signal to stop the screen brightness adjustment in step 550. The display unit 210 then stops adjusting the screen brightness in response to the adjustment stopping command signal and retains a level of screen brightness at a time point that the screen brightness adjustment is stopped. On the contrary, if the controller 230 ascertains that the measured level of illuminance is within the range of level corresponding to the screen brightness adjusting command signal at step 540, the controller 230 terminates the procedure. In that case, the display unit 210 may adjust the screen brightness to levels corresponding to the command signals from the controller 230.

Figure 6:
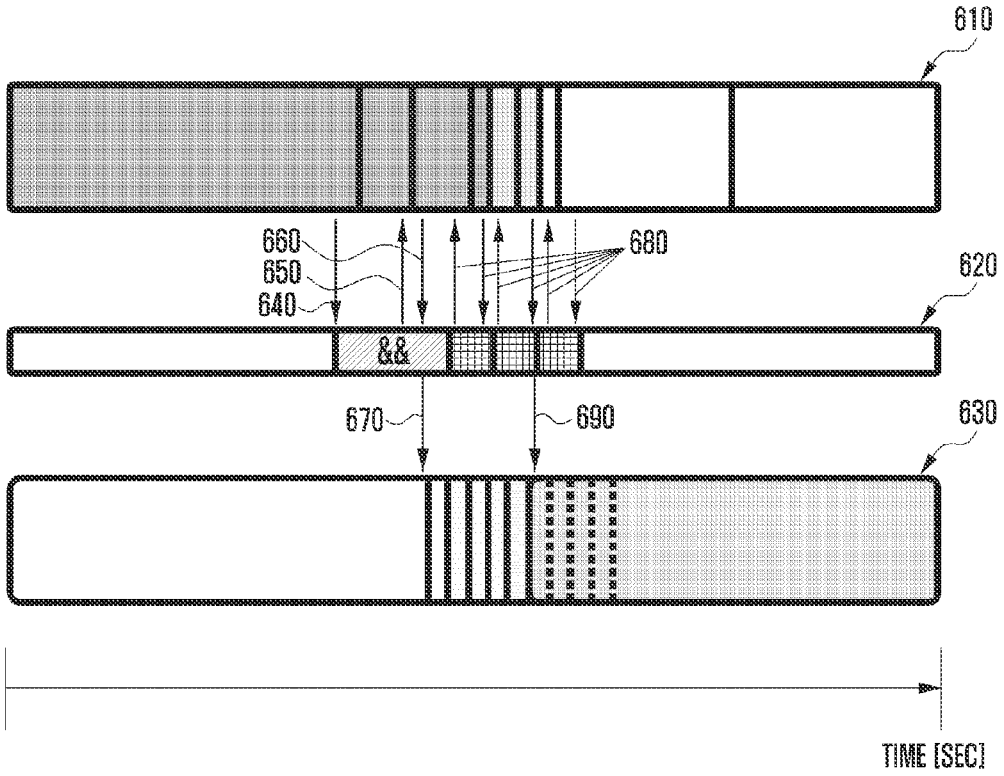
FIG. 6 illustrates operation state bars describing the second exemplary embodiment of a display control method according to an exemplary embodiment of the invention.

FIG. 6 illustrates operation state bars describing the second exemplary embodiment of a display control method according to an exemplary embodiment of the present invention, where the reference numbers 610, 620, and 630 refer to the operation state bars of the illuminance sensor 220, the controller 230, and the display unit 210, respectively.

Referring to FIGS. 5 and 6, the illuminance sensor 220, shown as operation state bar 610, continues detecting a low level of illuminance over a certain period of time. During the operation, if a state alteration event 640 occurs via a state alteration event creating algorithm, the illuminance sensor 220 creates the state alteration event signal and transfers the state alteration event signal to the controller 230.

The controller 230, shown as operation state bar 620, first transfers, to the illuminance sensor 220, a message 650 requesting the illuminance sensor 220 to measure an ambient illuminance and requesting the measured ambient illuminance therefrom. The illuminance sensor 220 measures the ambient illuminance in response to the request message 650. The illuminance sensor 220 transfers, to the controller 230, a reply message 660 including the measured level of illuminance. The controller 230 receives the reply message 660 and determines whether the measured level of illuminance included in the reply message 660 is within a range of illuminance level included in the state alteration event 640. If the controller 230 ascertains that the measured level of illuminance included in the reply message 660 is within the range of illuminance level included in the state alteration event 640, the controller 230 creates a command signal 670 for adjusting a screen brightness of the display unit 210 as shown as operation state bar 630. The command signal 670 is created in response to the state alteration event 640 to report that the ambient illumination state has been altered. The command signal 670 may be created in response to a state alteration event where the request message 650 is transferred.

The display unit 210 adjusts the screen brightness according to the command signal 670. The controller 230 can control the display unit 210 to gradually adjust the screen brightness from a current brightness level to a level corresponding to the command signal 670.

For example, it is assumed that the display unit 210 displays operates the screen brightness of a current level 100. If the display unit 210 receives, from the controller 230, a command signal 670 for adjusting the screen brightness to level 50, based on the state alteration event 640, the display unit 210 may gradually decrease the screen brightness level from level 100 to level 50, and then maintain the level 50.

After creating the command signal 670, the controller 230 may transfer another message requesting the illuminance sensor 220 to measure ambient illuminance and requesting the measured ambient illuminance therefrom, and then receive a reply message. For example, the controller 230 may transfer and receive feedback messages 680 for checking the current illuminance state to and from the illuminance sensor 220, while adjusting the screen brightness of the display unit 210.

If the controller ascertains that the measured level of illuminance included in the feedback message 680 is not within the range of level corresponding to the screen brightness adjusting command signal 670, the controller 230 then creates a signal 690 to stop the screen brightness adjustment. The display unit 210 then stops adjusting the screen brightness in response to the adjustment stopping command signal 690.

If the display unit 210 receives the adjustment stopping command signal 690 while gradually adjusting the screen brightness from level 100 to 50 according to the screen brightness adjusting command signal 670, the display unit 210 stops adjusting the screen brightness at a time point when the display unit 210 received the signal 690. For example, if the display unit 210 receives the adjustment stopping command signal 690 when the display unit 210 is adjusting the screen brightness at level 80 adjusting from level 100 towards level 50, the display unit 210 stops the screen brightness adjustment and retains the level at level 80.

If the display control system and method according to an exemplary embodiment of the present invention receives a signal created when an ambient illuminance state alteration event occurs, the display control system and method can request data of the currently measured illuminance and compare the current measured illuminance with an illuminance at a time when the event occurs. If the display control system and method ascertains that the illuminance state alteration event is reliable, the display control system and method adjusts a screen brightness. On the contrary, if the display control system and method ascertains that the illuminance state alteration event is not reliable, the display control system and method does not respond to the illuminance state alteration event.

If the display control system and method according to an exemplary embodiment of the present invention receives a signal created when an ambient illuminance state alteration event occurs, the display control system and method can adjust a screen brightness and be fed back with a current illuminance during the screen brightness adjustment. The display control system and method can also continue or stop adjusting the screen brightness according to the fed back current illuminance.

Therefore, the display control system and method according to an exemplary embodiment of the present invention can precisely react to a variation in the ambient illuminance environment and automatically adjust a screen brightness. The display control system and method determines whether the event for reporting that the ambient illuminance has been altered is reliable. The display control system and method can determine whether to continue or stop adjusting the screen brightness according to a screen brightness adjusting command by incorporating the ambient illuminance state during the screen brightness adjustment.

As described above, the display control system and method according to an exemplary embodiment of the present invention can enhance the reliability of a screen brightness adjusting command for a display. The display control system and method checks an illumination state near a display before executing the screen brightness adjusting command, incorporates the illumination state into the screen brightness state, and automatically adjusts the screen brightness of the display. The display control system and method can precisely respond to the variation of an external illumination environment near a display while controlling the screen brightness, and controls a stop of the screen brightness control operation. For example, the display control system and method can precisely control the screen brightness of a display, considering the variation of the ambient illumination near the display.

With the spread of digital convergence, although it is impossible to list all the modifications of mobile devices in this description, it will be easily appreciated by those skilled in the art that other components equivalent to the above-listed components may be further included to the mobile device according to the present invention. Also, it will be appreciated that, according to the purposes, the mobile device may be implemented by omitting a particular component or replacing it with other components. Although it is not shown in the drawings, the mobile device may selectively further include various types of components, for example, a sensor module for detecting a location of the mobile device and the variation, a Global Positioning System (GPS) module for measuring a location of the mobile device, a camera module, etc. It should be understood that the display control system may further include an input unit, a key input unit, a touch pad, a trackball, etc.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A display control method comprising:

receiving a signal corresponding to a state alteration event related to an illumination state alteration from an illuminance sensor;

transferring a first request message requesting measurement data of the ambient illuminance in response to the event signal to the illuminance sensor;

receiving a first replay message including the measurement data from the illuminance sensor;

determining whether the measurement data included in the first reply message is within a range of illuminance level; and adjusting, if the measurement data included in the first reply message is within a range of illuminance level, screen brightness of a display unit in response to the event signal, wherein the illuminance sensor includes an illuminance meter for periodically measuring the ambient illuminance levels and a sensor managing unit for detecting an alteration in illuminance based on the ambient illuminance levels measured from the illuminance meter and for creating the state alteration event by whether the altered illumination state is maintained for a threshold period of time.

2. The method of claim 1, wherein the event signal comprises: information regarding a measured illuminance level.

3. The method of claim 1, wherein the adjustment of screen brightness comprises: transferring a command signal including a level of screen brightness to be adjusted based on a range of illuminance level included in the event signal.

4. The method of claim 1, wherein the adjustment of screen brightness comprises:

transferring a command signal adjusting screen brightness to the display unit;

transferring a second request message for requesting measurement data of the ambient illuminance to the illuminance sensor;

receiving a second reply message including measurement data from the illuminance sensor; and transferring, if the measurement data included in the second reply message is not within a range of illuminance level corresponding to the command signal, a command signal to stop screen brightness adjustment to the display unit.

5. The method of claim 4, wherein the transfer of a second request message comprises: repeatedly transferring a second request message a preset number of times.

6. A display control method comprising:

receiving a signal corresponding to a state alteration event related to an illumination state alteration from an illuminance sensor;

transferring a command signal for adjusting screen brightness of a display unit in response to the event signal;

transferring a request message requesting measurement data of ambient illuminance to the illuminance sensor;

receiving a replay message including the measurement data from the illuminance sensor; and transferring, if the measurement data is not within a range of illuminance level corresponding to the command signal, a command signal to stop screen brightness adjustment to the display unit, wherein the illuminance sensor unit includes an illuminance meter for periodically measuring ambient illuminance levels and a sensor managing unit for detecting an alteration in illuminance based on the ambient illuminance levels measured from the illuminance meter and for creating the state alteration event by whether the altered illumination state is maintained for a threshold period of time.

7. A display control system comprising:

an illuminance sensor including an illuminance meter for periodically measuring ambient illuminance levels and a sensor managing unit for detecting an alteration in illuminance based on the ambient illuminance levels measured from the illuminance meter and for creating a state alteration event related to an illumination state alteration by whether the altered illumination state is maintained for a threshold period of time;

a display unit with a module for adjusting screen brightness, wherein the display unit displays graphics; and a controller for:

receiving a signal corresponding to the state alteration event from the illuminance sensor;

transferring a first request requesting measurement data of the illuminance in response to the event signal to the illuminance sensor;

receiving first measurement data from the illuminance sensor; and transferring, if the measurement data is within a range of illuminance level corresponding to the event signal, a command signal for adjusting screen brightness of the display unit in response to in response to the event signal.

8. The system of claim 7, wherein the controller:

transfers a second request requesting measurement data of the illuminance to the illuminance sensor;

receives second measurement data from the illuminance sensor; and transfers, if the second measurement data is not within a range of illuminance level corresponding to the command signal, a command signal to stop the screen brightness adjustment to the display unit.

9. A display control system comprising:

an illuminance sensor including an illuminance meter for periodically measuring ambient illuminance levels and a sensor managing unit for detecting an alteration in the illuminance based on the ambient illuminance levels measured from the illuminance meter and for creating a state alteration event related to an ambient illumination state alteration by whether the altered illumination state is maintained for a threshold period of time;

a display unit with a module for adjusting screen brightness, wherein the display unit displays graphics; and a controller for:

receiving a signal corresponding to an event related to an illumination state alteration from the illuminance sensor;

transferring a command signal for adjusting screen brightness of the display unit in response to the event signal;

requesting measurement data of illuminance from the illuminance sensor; receiving the measurement data from the illuminance sensor; and transferring, if the measurement data is not within a range of illuminance level corresponding to the command signal, a command signal to stop the screen brightness adjustment.

* * * * *